US010029717B2

(12) United States Patent
Cippollone et al.

(10) Patent No.: US 10,029,717 B2
(45) Date of Patent: Jul. 24, 2018

(54) RAILROAD TRACK CIRCUITS

(71) Applicant: Vossloh Signaling USA, Inc., Charlotte, NC (US)

(72) Inventors: John Cippollone, Vacaville, CA (US); Martin Smaha, Colton, CA (US)

(73) Assignee: Vossloh Signaling USA, Inc., Charlotte, NC (US)

( * ) Notice: Subject to any disclaimer, the term of this patent is extended or adjusted under 35 U.S.C. 154(b) by 0 days.

(21) Appl. No.: 14/504,931

(22) Filed: Oct. 2, 2014

(65) Prior Publication Data

US 2016/0096540 A1 Apr. 7, 2016

(51) Int. Cl.
*B61L 25/02* (2006.01)
*B61L 1/18* (2006.01)

(52) U.S. Cl.
CPC ..... *B61L 25/025* (2013.01); *B61L 1/187* (2013.01); *B61L 25/021* (2013.01)

(58) Field of Classification Search
CPC .. B61L 25/025; B61L 25/021; B61L 27/0077; B61L 27/0005
See application file for complete search history.

(56) References Cited

U.S. PATENT DOCUMENTS

| | | | | |
|---|---|---|---|---|
| 3,576,991 | A * | 5/1971 | Wilson | B61L 1/187 246/249 |
| 4,581,700 | A * | 4/1986 | Farnham | B61L 29/226 246/121 |
| 7,254,467 | B2 * | 8/2007 | Fries | B61L 29/226 701/19 |
| 2003/0010872 | A1 * | 1/2003 | Lewin | B61L 23/041 246/122 R |
| 2013/0270395 | A1 * | 10/2013 | Steffen, II | B61L 29/226 246/125 |
| 2014/0012438 | A1 * | 1/2014 | Shoppa | B61L 1/188 701/19 |
| 2014/0319286 | A1 * | 10/2014 | Hogan | B61L 29/226 246/122 R |

* cited by examiner

*Primary Examiner* — Michael J Zanelli
(74) *Attorney, Agent, or Firm* — Michael G. Monyok

(57) ABSTRACT

The present invention provides systems, methods and devices that accurately detect the speed and direction of vehicles on railroad tracks, and which use the information to calculate arrival times.

9 Claims, 4 Drawing Sheets

RAILROAD TRACK CIRCUITS

FIELD OF THE INVENTION

The present invention relates generally to circuits for railroads, and more specifically to using detected railroad track circuit measurements to calculate train metrics.

Problem Statement

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Track circuits for railroads allows engineers to predict train arrival times. A track circuit typically has power applied to each rail, and a relay coil wired across the rails conveys a current between the rails. When no train is on the track, the current flowing from the power source through the rails energizes the relay. When a train is on the track, its axles short (also called "shunt") the rails together. This causes the current to the track relay coil to drop and de-energize. Circuits through the relay contacts therefore report whether or not the track is occupied.

Each circuit detects a defined section of track, such as a block or zone, for example. These sections are typically separated by insulated joints, which are usually present in both rails. To prevent one circuit from falsely powering another in the event of insulation failure, the electrical polarity is usually reversed from section to section. Circuits are usually powered at low voltages (1.5 to 12 V DC) to protect against line power failures. Preferably, relays and the power supply are attached to opposite ends of a section to prevent broken rails from electrically isolating part of the track. Often, a series resistor is used to limit the current when the track circuit is short-circuited.

Audio signals are also used for track circuits. For example, coded signals between 2970 and 4950 hertz can be transmitted, and as a train or other vehicle approaches the Audio Frequency (AF) Receiver, rail-to-rail voltage decreases and rail-to-rail current increases, and the AF may increase or decrease depending on the travel of a train through the circuit. The for example, by calculating an average slope of the voltage and current curves, the vehicle speed can be estimated. What are needed are enhanced crossing warnings, decreased vehicle headway authority and other operational benefits from the data collected and computable from the track circuit. The present invention provides such devices, systems, and methods.

BRIEF DESCRIPTION OF THE DRAWINGS

Various aspects of the invention, as well as an embodiment, are better understood by references to the following detailed description. The detailed description, given by way of examples and not intended to limit the present invention solely thereto, will be better understood when read in conjunction with the drawings, in which.

EXEMPLARY EMBODIMENT OF A BEST MODE

Interpretation Considerations

Figure 1A:
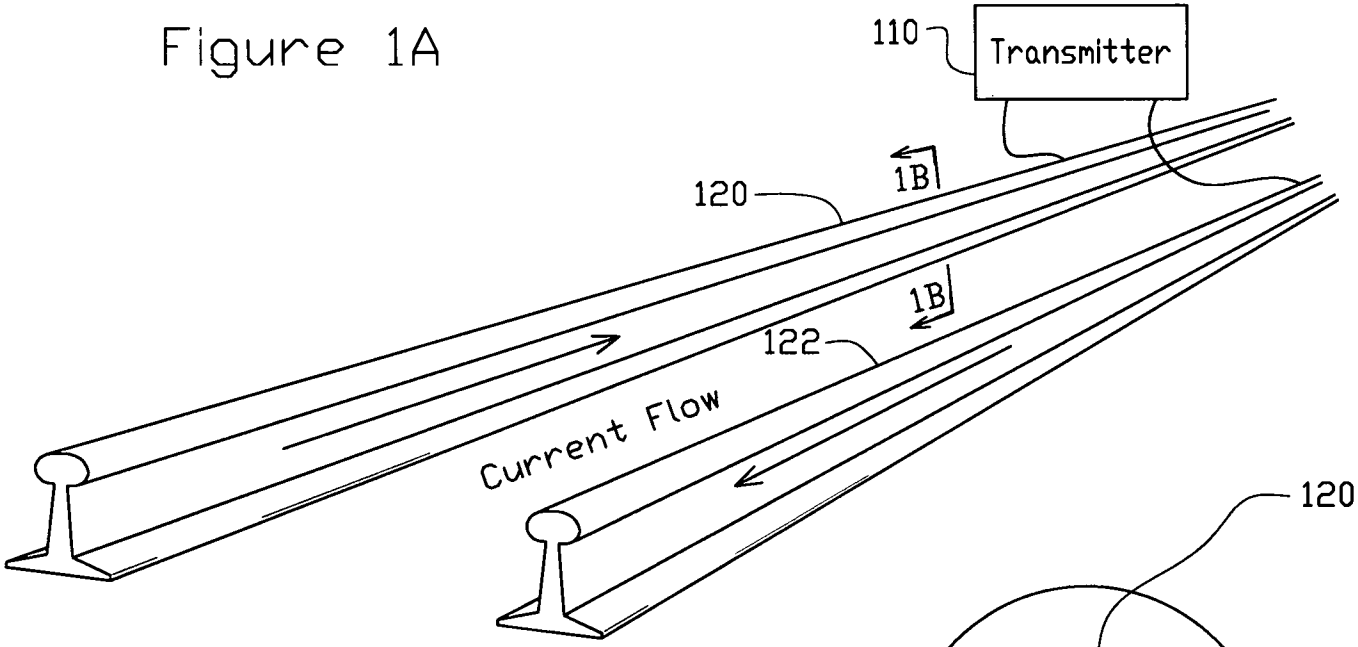
FIG. 1A-FIG. 1B illustrate an audio frequency transmitter coupled to railroad track rails, as well as magnetic flux lines generated from a current flowing through the rails.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in § 112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise. As will be understood by those of ordinary skill in the art, various structures and devices are depicted in block diagram form in order to avoid unnecessarily obscuring the invention.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

DETAILED DESCRIPTION OF THE DRAWINGS

Overview

The invention utilizes, in one embodiment, a sharp edge of detection associated with detected rail currents to provide a reliable detection zone for a track circuit. In addition, it offers the computation of train speed, velocity, and expected arrival time at a stationary target (such as a crossing gate) and a moving target (such as a train or car).

DESCRIPTION OF THE FIGURES

Figure 1B:
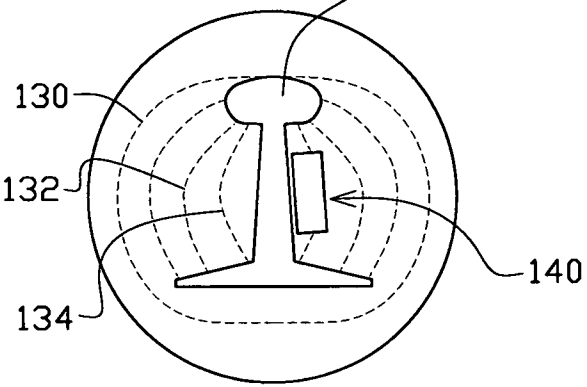

FIG. 1A illustrates an audio frequency transmitter 110 coupled to railroad track rails 120, 122, as well as magnetic flux lines 130-134 generated from the current flowing through the rails 120, 122. FIG. 1B is a cross-section view of the rail 120 taken across cut-line 1B-1B of FIG. 1A. A B-Point sensor 140 is illustrated as attached to the rail 120 in FIG. 1 B. The current flow is illustrated via the arrows in the rails 120, 122.

Figure 2:
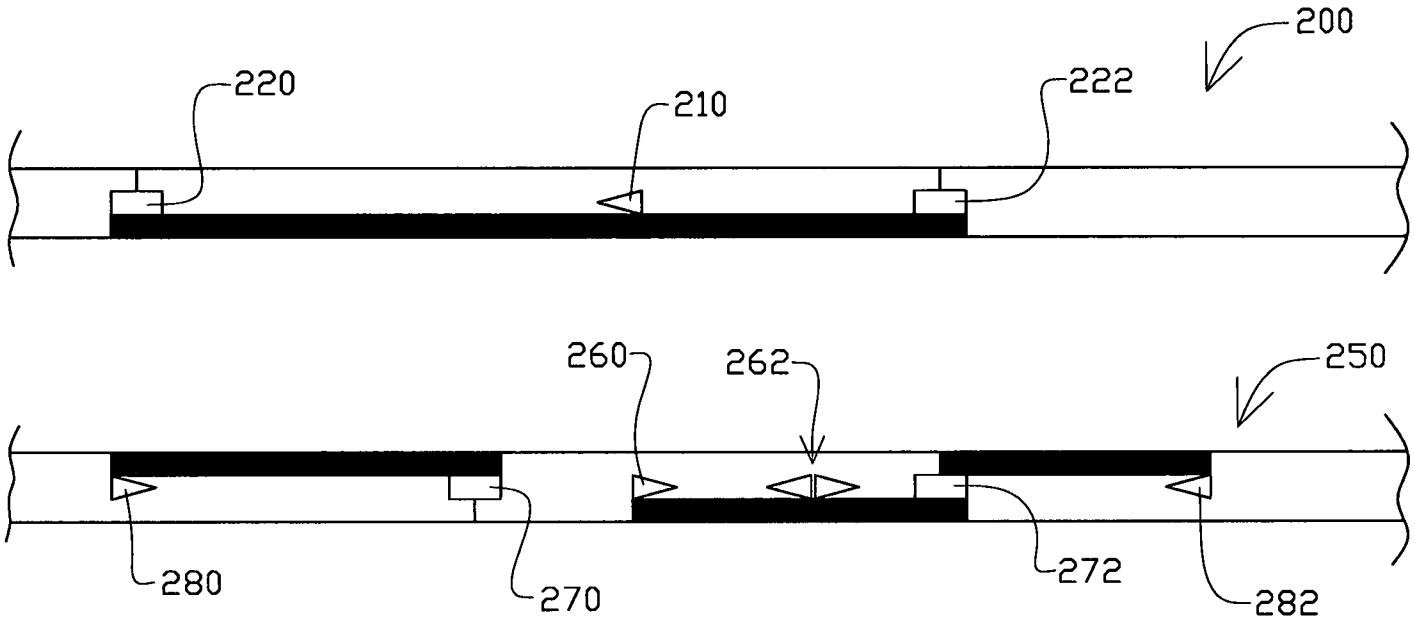
FIG. 2 illustrates a jointless audio frequency track circuit application having potential B-Point Uses.

FIG. 2 illustrates a first track section 200 as a jointless audio frequency track circuit application having potential B-Point Uses. Shunt zones are illustrated in different shading. A B-Point Coupler 210 is illustrated between a first AF Transmitter 220 and a second AF Transmitter 222.

On a second track section 250 a first B-Point Coupler 260, and a second B-Point Coupler 262 which is a 2-Receiver B-Point Coupler 262 are illustrated between a first AF Transmitter 270 and a second AF Transmitter 272. A third B-Point Coupler 280 is illustrated approaching the transmitters 270, 272 (in order), while a fourth B-Point Coupler 282 is illustrated approaching the transmitters 272, 270 (in order). Areas of different shading define different track sections or zones.

Figure 3:
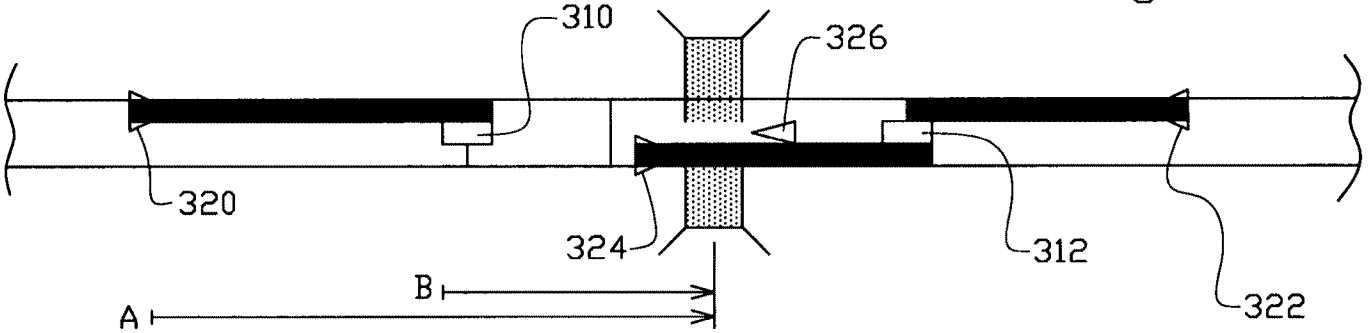
FIG. 3 illustrates a highway grade crossing having two transmitters and four B-Point Receivers.

FIG. 3 illustrates a highway grade crossing having two transmitters (first transmitter 310 and second transmitter 312) and four B-Point Receivers (320, 322, 324, and 326) provide unique and different types of grade crossing control. Compass directions are also illustrated via N-S, E-W lines. In addition, in FIGS. 3 and 4 horizontal lines represent a track or tracks associated with each illustrated track circuit, rather than rails. Transmitter F1 310 provides two approach circuits where distance A can provide a sharp cutoff point for a westbound approaching train while distance B can provide a fall-back detection point for slower-moving traffic (also, the lightly shaded zone as shown, when combined with the darker shaded zone provides a sharply defined island circuit). This application uses only two track frequencies as opposed to 3-track circuit applications or single predictor type applications. This type of application is particularly useful in transit type applications where the audio frequencies may be pre-existing for train control, or, predictor technology may not work well due to electrification. The added zones provide direction of movement detection as well as potential crossing activation delays when platforms located near the road require train stops. This type of application is typical for at-grade intercity transit type of applications where AF track circuits are already employed.

Figure 4:
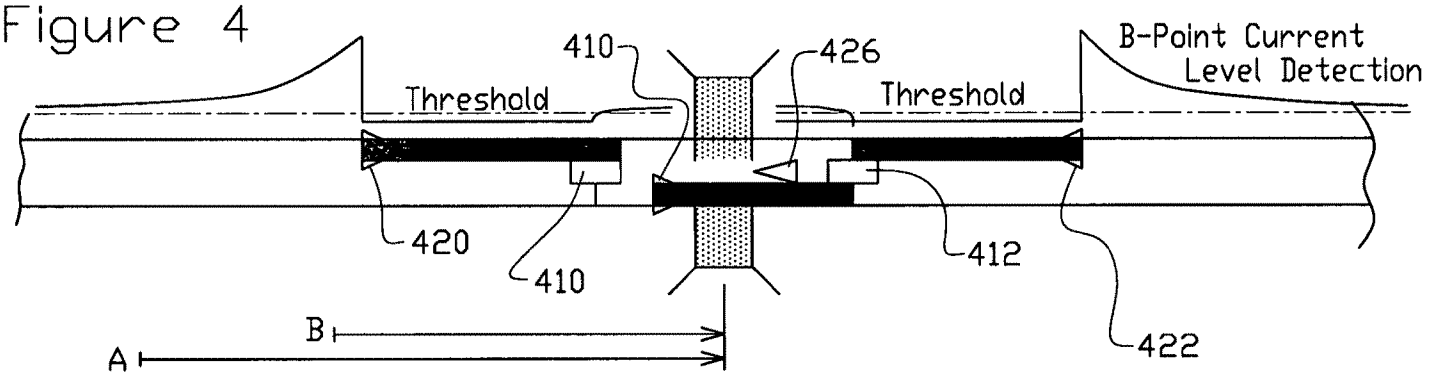
FIG. 4 illustrates a highway grade crossing with Motion Detection and CWT.

FIG. 4 illustrates a highway grade crossing with Motion Detection and CWT, having two transmitters (first transmitter 410 and second transmitter 412) and four B-Point Receivers (420, 422, 424, and 426). In this application, distance B can be set up as a fixed-type approach for the train minimum speeds activation point. Distance A (grey zone) is the primary measuring zone for maximum speed trains where more immediate crossing activation would be desired.

Motion Detection Using B-Point Couplers to Detect Rail Currents:

In a similar application to the previous figure, the analog current levels of the outer B-Point Couplers are measured and tracked to detect trends. The slope of the increasing current curve indicates motion of a train moving towards the crossing (as different from leaving the crossing). These levels provide direction information as well as a level of movement on the rails that can be measured to provide different system responses for different approach speeds. In a motion detection application, the simple detection of motion towards the crossing invokes the warning system.

Constant Warning Time and Speed Prediction:

This information can also be used with a little more processing power to measure the slope of the current curve in real-time, providing a measurement of speed of an approaching train with an approximate distance from the crossing. This added information provides adequate data for Constant Warning Time which can provide a consistent warning time despite widely varying train speeds. Constant Warning Time activation for grade crossing warnings will activate the crossing, for example, from a fast moving train at a farther distance from the crossing while slower trains moving towards the crossing will activate the warning when the train is closer to the crossing. The result is a constant, or at least more consistent warning time such that traffic on the highway is not delayed more or less for trains traveling at different speeds.

Figure 5:
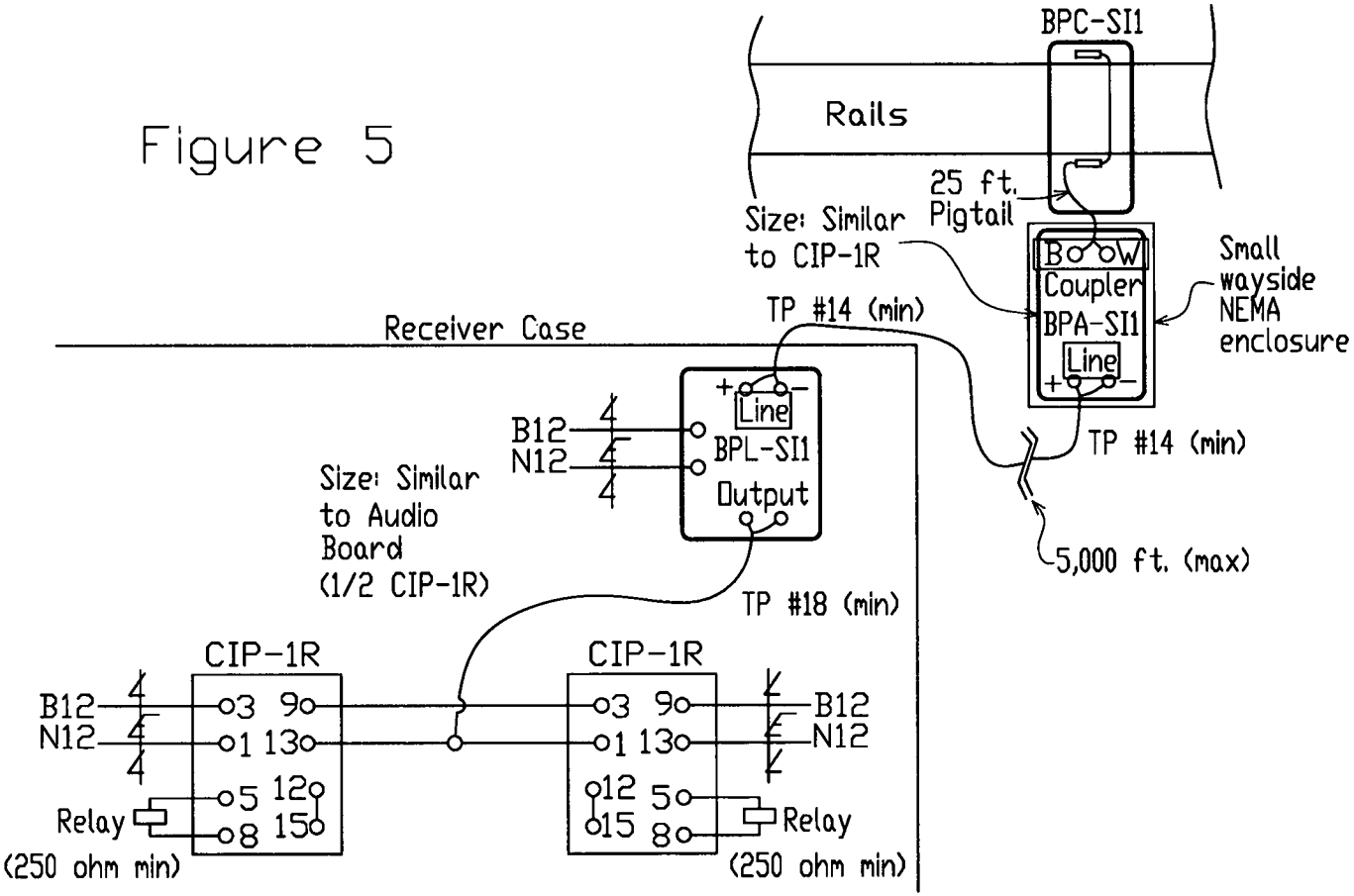
FIG. 5 illustrates a track circuit schematic.

FIG. 5 illustrates a track circuit schematic, which is understood by those of ordinary skill in the railroad industry arts.

Performance Specification—B-Point Couplers: Models BPC-SI1

Model BPC-SI1 provides high-resolution shunt detection capability with minimal interference from vehicle traction currents. Rail currents are detected using phased, paired coils that detect circulating track circuit currents while rejecting common mode propulsion currents.

The BPC-SI1 is provided complete with paired coils separated by 7-foot cable, and 25-foot pigtail for connection to a local junction box. Four rail clips are included with each unit (please specify rail gage with order). The BPC couplers are ideal for embedded rail applications where wire loops are not practical. One sensor of the pair mounts on each rail.

Preferred Embodiment Characteristics

- No pre-shunt or post-shunt distances, meaning precise track circuit limit definition.
- Directly compatible with GETS' B-Point Amplifiers, models BPA-4, BPA-4A and BPA-4B. Directly interchangeable with wire loop applications. Works with GETS' 700-series track circuit receivers.

Wideband operation works with track circuits from 1,000 to 20,000 hertz. No tuning modules required. Any frequency combination works directly with center fed applications.

Mounts quickly and easily on any gage rail using standard Erico snap-on rail clips. Low profile lies well within the rail web.

Anodized aluminum housing reduces oxidation and prolongs life. All hardware components are stainless steel to resist oxidation and prolong life. Coils are potted within housing for weatherproofing and shock proofing. Proven cold weather in-service operation.

Okonite™ direct-burial, shielded standard railroad cable

Specifications

Interface impedance: 1,000 ohms at 3 Khz

Directly compatible with BPA-4 Amplifiers (Use tuned BPT-series models for BPA-1 compatibility)

Though the invention has been described with respect to specific preferred embodiments, many variations and modifications will become apparent to those skilled in the art upon reading the present application. Specifically, the invention may be altered in ways readily apparent to those of ordinary skill in the art upon reading the present disclosure. It is therefore the intention that the appended claims and their equivalents be interpreted as broadly as possible in view of the prior art to include all such variations and modifications.

We claim:

1. A method, comprising:

receiving at least a first signal from a railroad track circuit, the railroad track circuit comprising a first audio frequency transmitter coupled between a first rail of a railroad track and a second rail of a railroad track, and a first audio frequency receiver coupled between the first rail of the railroad track and the second rail of the railroad track, the first audio frequency transmitter and the first audio frequency receiver being separated by no less than 20 feet;

detecting and defining a steady-state railroad track condition based on the first signal;

further defining the railroad track circuit to comprise an electrical coupler comprising at least a first track circuit receiver and a second track circuit receiver traversing between the first audio frequency transmitter and the first audio frequency receiver;

tracking a trend in a change of the first signal as compared to the steady-state railroad track condition as a train traverses the railroad track circuit; and computing via a computer processor at least one train metric selected from the group of: train speed, train location, or train direction based on the trend in the first signal.

2. The method of claim 1 wherein the first signal comprises a first magnetic flux line detected at the electrical coupler.

3. The method of claim 1, further comprising calculating a train rate of acceleration or deceleration based on the metric.

4. The method of claim 1, further comprising calculating a train's arrival time at a predetermined location based on the metric.

5. The method of claim 4 wherein the predetermined location is a crossing gate.

6. The method of claim 4 wherein the predetermined location is a railroad yard.

7. The method of claim 4 wherein the predetermined location is dynamic.

8. The method of claim 7 wherein the predetermined location is a second train.

9. The method of claim 1, wherein tracking a trend in the first signal as a train traverses the railroad track circuit comprises calculating a slope of a change in the first signal.

* * * * *